United States Patent [19]

Tomson

[11] 4,205,481

[45] Jun. 3, 1980

[54] BUBBLE VIEWING AND PRESERVING DEVICE

[76] Inventor: Steven H. Tomson, R.D. No. 4, Cazenovia, N.Y. 13035

[21] Appl. No.: 912,969

[22] Filed: Jun. 6, 1978

[51] Int. Cl.[2] ..... A63H 33/28

[52] U.S. Cl. ..... 46/6; 40/408

[58] Field of Search ..... 46/6–8, 46/406–408

[56] References Cited

U.S. PATENT DOCUMENTS

| | | | |
|---|---|---|---|
| 1,028,994 | 6/1912 | Cordtmeyer | 46/6 |
| 1,550,057 | 8/1925 | Beeler | 40/408 |
| 1,646,398 | 10/1927 | Gaffin | 46/6 |
| 3,971,157 | 7/1976 | Gillis | 46/7 |

*Primary Examiner*—Charles E. Phillips
*Attorney, Agent, or Firm*—Brumbaugh, Graves, Donohue & Raymond

[57] ABSTRACT

This invention relates to an apparatus and method for preserving bubbles permitting prolonged observation of the bubble. The device comprises, a bubble on a support therefor and a housing around the support for isolating and protecting the bubble from the environment outside of the housing. Means are also provided for increasing the humidity and atmospheric pressure within the housing so as to provide an environment therein conducive to the preservation of the bubble. The housing includes a transparent dome member. This application also discloses a method for preserving a bubble which comprises maintaining the humidity and increasing atmospheric pressure within the housing.

12 Claims, 4 Drawing Figures

BUBBLE VIEWING AND PRESERVING DEVICE

FIELD OF THE INVENTION

This invention relates to a device and method for preserving bubbles, permitting prolonged observation of the bubbles.

DESCRIPTION OF THE PRIOR ART

The prior art discloses amusement or advertising devices for displaying bubbles. For example, Beeler U.S. Pat. No. 1,550,057 discloses a glass jar retained within a cylindrical member containing bubble solution. In operation, bubbles are formed by forcing air through the bubble solution. The bubbles formed fill the glass jar and overflow into a reservoir containing bubble solution and rapidly condense back into solution.

Stott, U.S. Pat. No. 971,091 discloses an advertising or amusement device for blowing bubbles which comprises a cylinder containing bubble-forming solution through which air is forced. The bubbles formed by the passage of the air through the solution fill the cylinder and overflow onto a basin.

Steinhauser U.S. Pat. No. 710,814 also discloses an advertising device for blowing bubbles which comprises a soap holder, above which a tube member, surrounded by a receiving pan is disposed. In operation, air is forced through the soapy liquid thereby forming bubbles which fill the tube and overflow onto the receiving plate. The bubbles rapidly burst on the receiving plate and the soapy liquid of which the bubble was formed is channelled back into the soap holder.

DESCRIPTION OF THE INVENTION

It is an object of the present invention to provide an apparatus and method for preserving bubbles for prolonged observation. Another object of this invention is to provide a device and method for displaying bubbles and enhancing their beauty while on display.

In accordance with the foregoing objectives, this invention provides an apparatus for preserving bubbles comprising bubble supporting means, housing means for encasing said bubble supporting means, thereby isolating a bubble supported on said bubble supporting means from the environment outside of said housing means, and means for maintaining humidity within the housing. Preferably, the bubble preserving device further includes means for elevating the atmospheric pressure within the housing.

This invention also provides a method for preserving a bubble for prolonged observation comprising maintaining the humidity within a housing containing a bubble supported on a bubble stand within a housing. In a preferred embodiment, the method further includes the step of increasing the atmospheric pressure within the housing.

Still other objects and advantages of the present invention will be apparent from the specification and attached drawings wherein.

The present invention relates to an apparatus and method for preserving a bubble for prolonged observation. An ordinary soap bubble will survive for only a matter of seconds in the open air before bursting. The instant invention however, provides an apparatus within which a bubble may be displayed in an environment of relatively high humidity and slightly elevated pressure. When bubbles are maintained in an environment as hereinafter described, the life of the display bubble is significantly prolonged and the beauty of the bubble is enhanced. The display of the bubble on its support and within its housing, especially when surrounded by a background, such as black material is particularly restful to the observer.

In accordance with the present invention a bubble is supported on a stand and thereafter encased within a housing which acts to isolate the bubble from the atmospheric environment. The environment within the housing is controlled to maintain a relatively high humidity and slightly elevated atmospheric pressure. It has been found that under these conditions that an ordinary soap bubble can survive for up to about a median time of 235 to 355 minutes, and as much as 10–12 hours. Devices as described herein are useful as providing a hitherto unavailable method for displaying a bubble for a prolonged period of time. Moreover, a highly attractive prismatic effect is produced on the surface of the bubble displayed within the bubble preserving apparatus. Such devices may be used in connection with advertising matter, toys and games for children (and adults) and educational devices.

Figure 1:
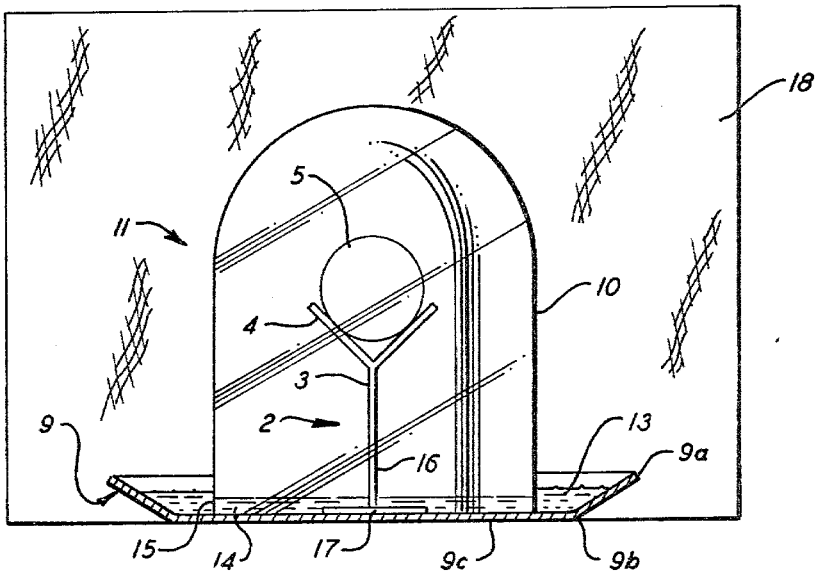
FIG. 1 is a cross-sectional view of the bubble preserving device taken along line 1—1 of FIG. 2.
Figure 2:
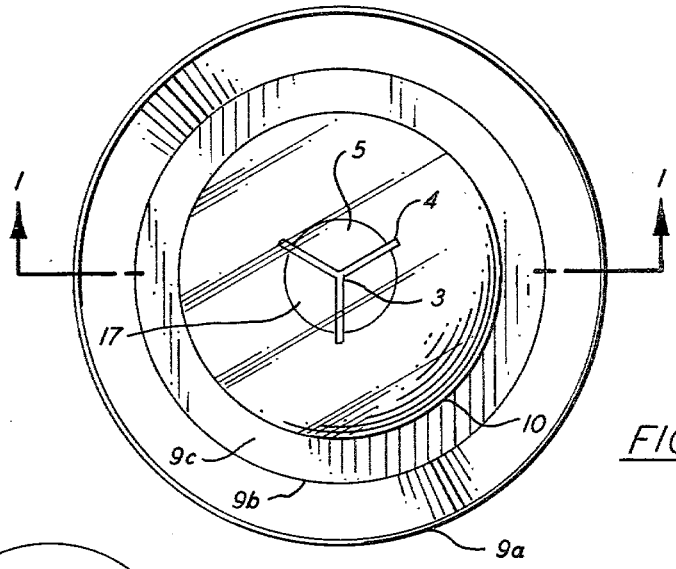
FIG. 2 is a top elevational view.
Figure 3:
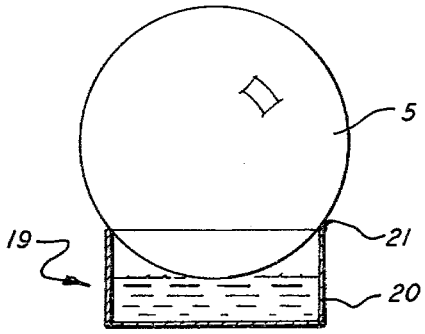
FIG. 3 is a cross-sectional view of an alternative embodiment of the bubble stand.
Figure 4:
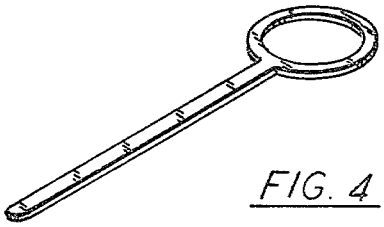
FIG. 4 is a perspective view of a bubble wand.

In the instant invention a bubble may be produced by forcing air though a conventional bubble wand depicted by FIG. 4, which has been wetted with bubble-forming solution. The bubble is then carefully transferred from the bubble wand to the bubble stand (2). The term bubble solution as employed herein, refers to a soap-water (or detergent-water, or other surfactant-water) solution, an oil or other liquid from which a bubble may be produced, for example low molecular weight film forming polymeric materials.

In a preferred embodiment of the bubble preserving device, the bubble stand (2) comprises a tripodial mounting member (3) within which the bubble rests. The tripod (3) is in turn supported by a vertical support member (16) and base (17). Preferably, the arms (4), of the tripod are moistened with water, bubble solution (or bubble replenishing liquid) or an oil such as mineral oil.

In another embodiment of the bubble preserving apparatus, the bubble stand (19) comprises a reservoir (20) and has an O-shaped mouth (21) upon which the display bubble (5) is mounted. The reservoir (20) contains a bubble replenishing liquid such as bubble solution or water. Preferably, the level of the liquid in the reservoir is adjusted so that the lowermost portion of the display bubble (5) supported by the O-shaped mouth (21) of the bubble stand contacts the bubble solution in the reservoir. The contact between the bubble and the liquid within the reservoir (20) provides a means for replenishing the display bubble and, hence retards the deterioration of the bubble.

A bubble supported on a bubble stand as described above is then encased in a housing (11) to isolate the bubble from the atmospheric environment. The housing comprises a base or plate (9) containing a liquid (13), and a cooperating transparent dome or bell jar (10). The plate (9) comprises sidewalls (9(*a*)) and base member (9(*c*)) which are joined at (9(*b*)). Preferably, base-liquid (13) is bubble solution, although water, oil or other liquids which will be apparent to those skilled in the art may also be employed.

The dome (10) has a single opening at its lowermost end (14) of sufficient diameter to accept and encompass the bubble stand. When the dome is placed over the bubble stand, such that it is resting on the plate (9), the liquid (13) within the base (9) surrounds the lowermost exterior wall (15) of the dome and forms an air-tight seal between the dome and the base. The atmospheric pressure within the dome becomes slightly elevated when the dome is set down on the base. The increase in atmospheric pressure occurs because the volume of air within the dome is reduced as a function of the height of water in the base. In other words, at the point where the rim of the dome intersects the water level, the pressure inside and outside the dome are essentially the same. However, as the rim of the dome moves beneath the surface of the water, the gaseous volume within the dome is reduced thereby increasing the pressure therein. The increase in pressure tends to stabilize the bubble within the casing. Also, the slight increase in pressure tends to uniformly compress the walls of the bubble, which, it is believed, contributes to the increased stability of the bubble.

Evaporation of the liquid within the stand and base produces an environment of relatively high humidity within the limited interior volume of the dome. It is believed that by mounting the bubble in an environment of high humidity, the bubble is further stabilized, thereby contributing to its prolonged life for viewing. In a preferred embodiment of the instant invention the humidity within the dome is further increased by moistening the interior surface of the dome with water or bubble solution.

As is evident from the above description, several factors contribute to the preservation of a bubble within the instant device; that is, the dome and base apparatus protect the bubble from stray air currents while providing an environment of increased pressure and humidity condusive to the preservation and stabilization of the bubble. In addition, the bubble is supported within the device by a bubble stand wherein the bubble contacts a source of bubble replenishing liquid such as water or bubble solution.

In the preferred embodiment of the present invention the base and bubble stand are moistened with bubble solution and, the interior surface of the dome is likewise coated or moistened with bubble solution. However, as will be apparent to those skilled in the art, the base may contain other bubble replenishment liquids such as water, the bubble stand may also contain water or other bubble replenishing liquid, and the dome may be moistened with water rather than bubble solution. The following table summarizes the median lifetime in minutes observed for various water-bubble solution embodiments of the device. The median bubble lives* listed were calculated on the basis of 30 trials within each of the Systems I–V below:

TABLE I

| SYSTEM | MEDIAN BUBBLE LIFE |
|---|---|
| I. Bubble stand reservoir and base contain bubble solution, and interior surface of dome moistened with bubble solution. | 355 Minutes |
| II. Bubble stand reservoir contains bubble solution, water in base, and interior surface of dome moistened with water. | 249 Minutes |
| III. Bubble stand tripod O-ring moistened with water, base contains water and dome interior moistened with water. | 235 Minutes |
| IV. Bubble stand reservoir contains water, water in base, unmoistened dome. | 31 Minutes |
| V. Bubble stand contains water, and bubble stand not encased in housing. | 34.5 Seconds |

*The test bubbles were prepared from Chemtoy Corp. ® bubble solution.

In System V summarized above, a median lifetime of only about 35 seconds is observed for a bubble mounted in open air on a water containing bubble stand. By way of contrast, bubbles mounted in the device of this invention, namely, wherein the interior surface of the dome is moistened with either bubble solution or water and the base is wetted (Systems I–III) may be preserved for a period of hours. Even in the less humid environment produced within the housing of System IV in which the interior surface of the dome is not moistened, a median bubble life of 31 minutes is observed. In accordance with the preferred embodiment of the housing wherein the bubble stand and base contain bubble solution and the interior surface of the dome is moistened with bubble solution (System I) a bubble may be preserved for as long as 10–12 hours, while the median bubble life in this system is 6 hours.

A highly attractive prismatic effect is produced on the walls of the bubble when light strikes the bubble supported within the bubble preserving apparatus. This effect is enhanced by placing a colored cloth or background (18) behind the dome. The appearance and visibility of the bubble may also be enhanced by employing a bubble solution containing a dye to form the bubble.

The bubble supports (2), (19) may be formed of plastic, metal, wood and may be painted or varnished to contrast with the bubble. In addition, the bubble support (19) may be formed of a clear plastic or glass and may contain a colored bubble replenishing liquid, such as bubble solution to which a dye has been added.

Bubble supporting devices in addition to those discussed in detail herein will occur to those skilled in the art. For example, the bubble stand may comprise an O-shaped ring laterally supported by a tripod or other supporting means.

The dome member (10) may be formed of transparent materials such as glass, clear plastics such as polymethylmethacrylate, or clear flexible materials such as cellophane, which may be secured about the perimeter of the liquid containing base and inflated to increase the pressure within the casing.

Alternatively, the dome may be formed of non-transparent materials such as wood or a colored plastic, and a viewing window formed of a transparent material such as glass or cellophane may be provided in an appropriate position on the dome wall. In addition, the background member (18) may be placed within the dome behind the bubble. For example, a colored background formed of cloth or cardboard may be secured to the dome wall behind the bubble, or otherwise suspended from the dome walls. For example, hooks may be provided on the uppermost dome ceiling and a cloth background may be suspended from the hooks.

The base member (9) may be formed of wood, or a transparent material such as glass, or a clear plastic such as polymethylmethacrylate. The liquid within the transparent base may be colored to contrast with the bubble. For this purpose, bubble solution to which a dye has been added may be employed. The base may also be comprised of wood, a metal such as aluminum, or a ceramic material such as porcelain or plaster. In addition, a groove or channel may be provided on the sidewall or base floor within which the lowermost rim of the dome is retained.

While specific embodiments of the bubble viewing and preserving device and method of this invention have been described with particularity herein, it will be understood that it is intended to cover all changes and modifications of the embodiments of the invention herein chosen for purposes of illustration which do not constitute departures from the spirit and scope of the invention.

I claim:

1. A device for preserving and observing bubbles comprising:
   (a) A bubble on a supporting means therefore;
   (b) housing means for encasing said bubble supporting means comprising liquid containing base means, and transparent dome means having an open end and a closed end, wherein the open end of said dome means rests on said liquid containing base means to provide an airtight seal therebetween, and to provide an increase in atmospheric pressure about the bubble within the housing.

2. A bubble preserving device according to claim 1 wherein said bubble supporting means contains bubble replenishing liquid in said means and wherein the supported bubble contacts the bubble replenishing liquid contained therein.

3. A bubble preserving device according to claim 1, wherein said base contains bubble replenishing liquid.

4. A bubble preserving device according to claim 3, including background means for enhancing the appearance of the bubble.

5. A bubble preserving device according to claim 1, wherein said dome member includes on the interior surface thereof a coating of a liquid selected from the group consisting of water and bubble replenishing liquid.

6. The bubble preserving device according to claim 1, wherein said bubble supporting means comprises a tripod on which the bubble rests.

7. The bubble preserving device according to claim 6, wherein said bubble supporting tripod includes a coating of a liquid selected from the group consisting of water, bubble replenishing liquid and mineral oil, at the points of contact between said bubble supporting tripod and said bubble.

8. The bubble preserving device according to claim 7, wherein:
   (a) said base contains bubble replenishing liquid; and,
   (b) said bubble supporting tripod includes a coating of bubble replenishing liquid.

9. The bubble preserving device according to claim 8, wherein said dome member includes a coating of a liquid selected from the group consisting of water and bubble replenishing liquid on its interior surface.

10. The bubble preserving device according to claim 9, including background means for enhancing the appearance of the bubble.

11. The bubble preserving device according to claim 6, wherein:
   (a) said base contains water;
   (b) said bubble supporting means includes a coating of bubble replenishing liquid; and,
   (c) the interior of said dome member includes a coating of bubble replenishing liquid.

12. A bubble preserving device according to claim 1, wherein:
   (a) said bubble supporting means is coated at the points of contact with the bubble with a liquid selected from the group consisting of water, bubble replenishing liquid and mineral oil; and,
   (b) the interior surface of said dome member includes a coating of bubble replenishing liquid.

* * * * *